US011830324B2

(12) United States Patent
Haishima

(10) Patent No.: US 11,830,324 B2
(45) Date of Patent: Nov. 28, 2023

(54) BANKNOTE PROCESSING TERMINAL

(71) Applicant: Universal Entertainment Corporation, Tokyo (JP)

(72) Inventor: Jun Haishima, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 207 days.

(21) Appl. No.: 17/428,062

(22) PCT Filed: Feb. 4, 2020

(86) PCT No.: PCT/JP2020/004023
§ 371 (c)(1),
(2) Date: Aug. 3, 2021

(87) PCT Pub. No.: WO2020/162421
PCT Pub. Date: Aug. 13, 2020

(65) Prior Publication Data

US 2022/0130209 A1 Apr. 28, 2022

(30) Foreign Application Priority Data

Feb. 5, 2019 (JP) ..... 2019-018547

(51) Int. Cl.
*A63F 9/24* (2006.01)
*G07F 17/32* (2006.01)

(52) U.S. Cl.
CPC ..... *G07F 17/3246* (2013.01); *G07F 17/3216* (2013.01); *G07F 17/3223* (2013.01)

(58) Field of Classification Search
None
See application file for complete search history.

(56) References Cited

U.S. PATENT DOCUMENTS 6,612,575 B1 * 9/2003 Cole ..... G07F 17/3239 463/20
2009/0054149 A1 * 2/2009 Brosnan ..... G07F 17/32 463/42

FOREIGN PATENT DOCUMENTS

| | | | |
|---|---|---|---|
| JP | 2001022228 | A | 1/2001 |
| JP | 2006208475 | A | 8/2006 |
| JP | 2012141897 | A | 7/2012 |
| JP | 2013127805 | A | 6/2013 |
| JP | 2015069422 | A | 4/2015 |

(Continued)

OTHER PUBLICATIONS

International Search Report dated Apr. 14, 2020, issued in International Application No. PCT/JP2020/004023.

(Continued)

*Primary Examiner* — Sunit Pandya
(74) *Attorney, Agent, or Firm* — United IP Counselors, LLC; Kenneth M. Fagin

(57) ABSTRACT

An object of the present invention is to provide a banknote processing terminal capable of reducing a necessity of confirmation by a user when the user uses a foreign currency. A slot machine G10 displays a confirmation screen 721 for determining whether to execute exchange of a foreign currency, and is able to receive an input for selecting whether no further confirmation is necessary by the confirmation screen 721. When a selection indicating that no further confirmation is necessary is received, display of the confirmation screen is cancelled after this.

4 Claims, 9 Drawing Sheets

(56) References Cited

FOREIGN PATENT DOCUMENTS

| | | | |
|---|---|---|---|
| JP | 2016099656 | A | 5/2016 |
| JP | 2018190155 | A | 11/2018 |

OTHER PUBLICATIONS

Written Opinion dated Apr. 14, 2020, issued in International Application No. PCT/JP2020/004023.

* cited by examiner

BANKNOTE PROCESSING TERMINAL

TECHNICAL FIELD

The present invention relates to a banknote processing terminal.

BACKGROUND ART

A known banknote processing terminal capable of receiving a banknote is connected to, e.g., a gaming machine provided in a gaming facility. The banknote processing terminal accepts only a local currency of the country where the banknote processing terminal is provided, and is able to distinguish the face value (see Patent Literatures 1 and 2).

CITATION LIST

Patent Literatures

[PLT 1] Japanese Unexamined Patent Publication No. 2013-127805

[PLT 2] Japanese Unexamined Patent Publication No. 2012-141897

SUMMARY OF INVENTION

Technical Problem

With increase of travelers and sojourners from foreign countries, gaming machines are increasingly required to accept foreign currencies. For example, in order to enable not only the play with a local currency which is set for the gaming machines but also the play with foreign currencies, banknote processing terminals connected to the gaming machines are required to accept foreign currencies in addition to a local currency. In other words, each banknote processing terminal is required to be arranged so that foreign currencies can be directly accepted and can be exchanged for a local currency of the country in which the banknote processing terminal is provided. Assume that the banknote processing terminal is structured as such. In this case, when a piece of a foreign currency is inserted, the piece of the foreign currency is received only after a confirmation screen including an exchange rate is displayed and a user understands the exchange rate. However, such an agreement in which a confirmation screen is displayed each time a piece of a foreign currency is inserted may be more laborious for a user than the exchange of a foreign currency by a user in advance.

An object of the present invention is to provide a banknote processing terminal which makes it possible to solve the above-described problem occurring when a user uses a foreign currency.

Solution to Problem

A banknote processing terminal of the present invention includes:

a display unit configured to display a confirmation screen for determining whether to execute exchange of a foreign currency;

an input unit configured to receive an input from a user;

a storage unit which stores a content received by the input unit;

a reading unit configured to read information indicating whether a received piece of a currency is a foreign currency; and a control unit, the input unit is able to receive an input for selecting whether no further confirmation is necessary on the confirmation screen, and the control unit stores information indicating that confirmation is unnecessary in the storage unit when the input unit receives a selection indicating that no further confirmation is necessary, and cancelling display of the confirmation screen when the information indicating that no further confirmation is unnecessary is stored in the storage unit when a piece of a foreign currency is received.

With the arrangement above, when the received piece of a currency is a foreign currency, the confirmation screen for asking whether to execute the exchange of a foreign currency is displayed and an input for selecting whether no further confirmation is necessary on the confirmation screen is receivable. When it is selected that no further confirmation is necessary on the confirmation screen, the confirmation screen is not displayed when a piece of a foreign currency is further received. This minimizes the labor of a user for the confirmation of exchange of a foreign currency, and minimizes the labor of a user for confirmation involved in the use of a foreign currency.

In the banknote processing terminal of the present invention, the control unit may reset, at predetermined intervals, the information stored in the storage unit.

With the arrangement above, even when the user selects that no further confirmation is necessary, the information is reset at predetermined intervals and the confirmation screen is displayed again after the reset. This makes it possible to ask, at predetermined intervals, the user whether a piece of a currency inserted by the user is a desirable banknote.

In the banknote processing terminal of the present invention, the control unit may reset, at a time of changing an exchange rate, the information stored in the storage unit.

With the arrangement above, even when the user selects that no further confirmation is necessary, the information is reset at each time of changing an exchange rate and the confirmation screen is displayed again after the reset. This makes it possible to notify the user of information of change of the rate.

The banknote processing terminal of the present invention is a gaming machine, and the control unit may reset, when the user playing the gaming machine ends a game, the information stored in the storage unit.

With the arrangement above, even when the user selects that no further confirmation is necessary, the information is reset at each time of ending a game by the user playing the game and the confirmation screen is displayed again after the reset. This makes it possible to display the confirmation screen again when another user plays a game.

PREFERRED EMBODIMENT OF INVENTION

Figure 1:
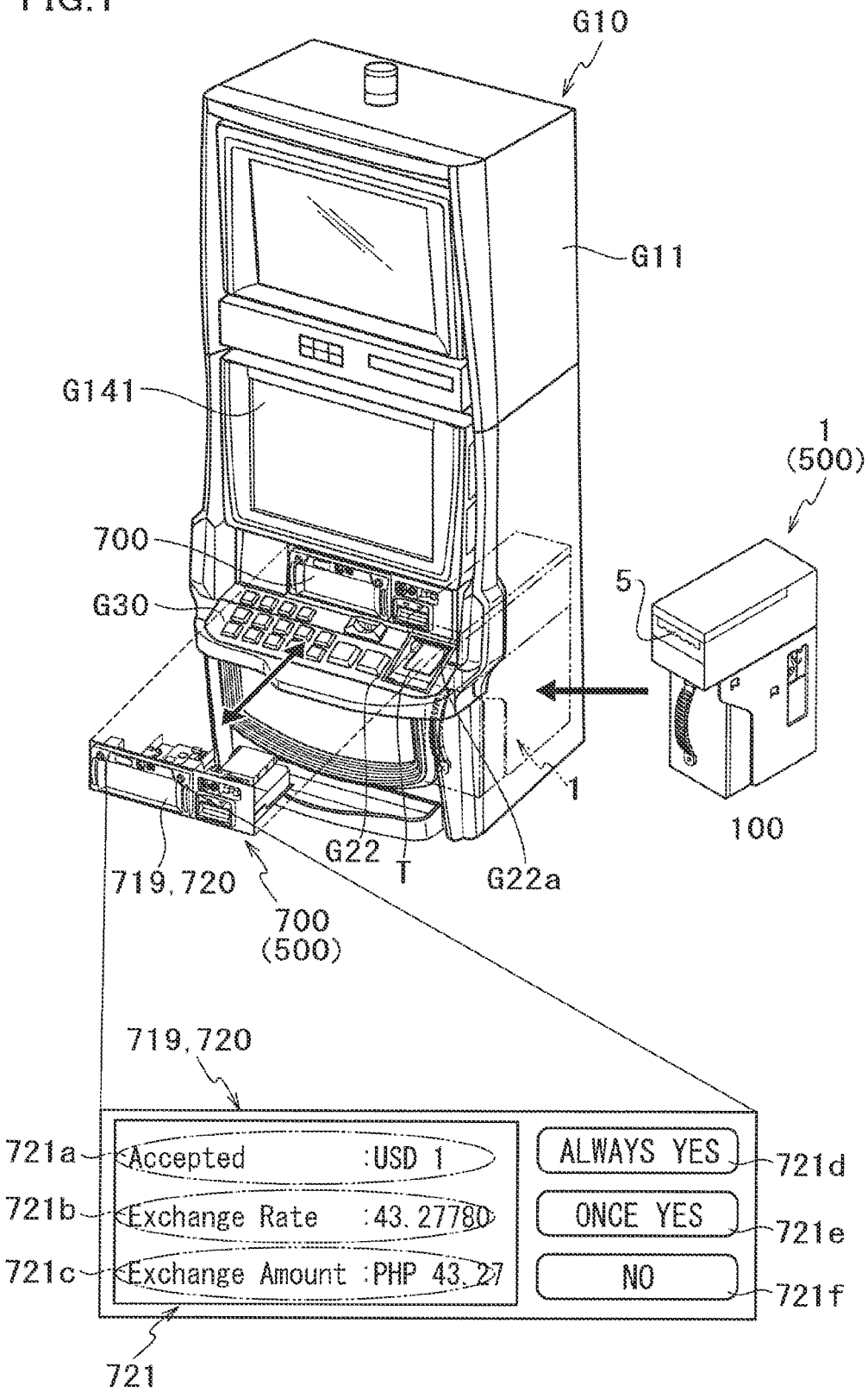
FIG. 1 illustrates the outline of a banknote processing terminal.

As shown in FIG. 1, a banknote processing terminal 500 of the present embodiment includes a banknote processing device 1 capable of storing a banknote T which is a type of paper stock and a PTS terminal 700 configured to enable data communication with a management server 260. The banknote processing device 1 and the PTS terminal 700 are embedded in a slot machine G10. In other words, the slot machine G10 includes therein the banknote processing device 1 and the PTS terminal 700 which function as a banknote processing terminal 500. The slot machine G10 functions as a gaming machine configured to run a game, in addition to function as the banknote processing terminal 500. The slot machine G10 is configured to read a currency type and monetary amount of a piece of a foreign currency which is received by the banknote processing device 1, is configured so that exchange is done by the PTS terminal 700 based on an exchange rate, and is configured so that a game is run by the slot machine G10 based on credits corresponding to the amount of money after the exchange. While the slot machine G10 of the present embodiment includes the banknote processing terminal 500 as described above, the disclosure is not limited to this. For example, the banknote processing terminal 500 may be formed and provided to be independent from the slot machine G10.

As shown in FIG. 1, the banknote processing terminal 500 is configured to display a confirmation screen 721 for asking whether to allow the PTS terminal 700 to exchange a piece of a foreign currency when the banknote processing device 1 receives the piece of the foreign currency. The confirmation screen 721 is displayed on an LCD 719 functioning as a display unit included in the PTS terminal 700. The confirmation screen 721 displays received banknote information 721*a* indicating a currency type and monetary amount of a received banknote T, exchange rate information 721*b* indicating an exchange rate, and exchange information 721*c* indicating a monetary amount of a local currency after the exchange. The confirmation screen 721 further displays a first approval button 721*d*, a second approval button 721*e*, and a refusal button 721*f* The surface of the LCD 719 is provided with a touch panel 720 functioning as an input unit, and receives an input corresponding to each of the buttons 721*d*, 721*e*, and 721*f* in such a way that a touch input is made into each of areas in which the first approval button 721*d*, the second approval button 721*e*, and the refusal button 721*f* are respectively displayed.

The first approval button 721*d* and the second approval button 721*e* are input areas for approving the exchange which is indicated in the received banknote information 721*a*, exchange rate information 721*b*, and exchange information 721*c* of the confirmation screen 721. That is, as a user makes a touch input into the first approval button 721*d* and the second approval button 721*e*, the exchange which is indicated on the confirmation screen 721 is done.

In this regard, the banknote processing terminal 500 is configured not to display the confirmation screen 721 after this exchange of a foreign currency in a case in which a touch input is made into an input area of the first approval button 721*d*. Meanwhile, the banknote processing terminal 500 is configured not to display the confirmation screen 721 even after this exchange of a foreign currency in a case in which a touch input is made in an input area of the second approval button 721*e*. That is, in the banknote processing terminal 500, the touch panel 720 is able to receive an input for selecting whether no further confirmation is necessary on the confirmation screen.

The banknote processing terminal 500 is configured to store information indicating that confirmation is unnecessary in a case in which a touch input is made into the input area of the first approval button 721*d*. Therefore, when the banknote processing terminal 500 receives a piece of a foreign currency next time and information indicating that confirmation is unnecessary is stored, the display of the confirmation screen 721 is canceled.

As described above, when a received banknote is a foreign currency, the confirmation screen 721 for asking whether to execute the exchange of a foreign currency is displayed and an input for selecting whether no further confirmation is necessary is receivable by the confirmation screen 721. When it is selected that no further confirmation is necessary on the confirmation screen 721, the confirmation screen 721 is not displayed each time a piece of a foreign currency is further received. This minimizes the labor of a user for the confirmation of exchange of a foreign currency, and minimizes the labor of a user for confirmation involved in the use of a foreign currency.

Banknotes are a type of currency. The term "currency" encompasses not only legal currencies issued by governments but also local currencies each used in a particular community and international currencies transacted internationally, such as Euro and United States Dollar. The term "currency circulation zone" indicates a geographical range in which the currency is used for transaction. For example, in case of a currency circulated in a country, the range within the border of the country is the currency circulation zone. In case of a common currency circulated in an area constituted by a plurality of countries, the area is the currency circulation zone. Furthermore, in case of a currency circulated in a region of a country, the region is the currency circulation zone.

The slot machine G10 has a cabinet G11, and the cabinet G11 has a bill entry G22 having an insertion slot G22*a* through which banknotes from the outside are received. Banknotes T are therefore received by the banknote processing device 1 through the insertion slot G22*a* of the bill entry G22.

The banknote processing device 1 is embedded in the slot machine G10, and is provided in the cabinet G11 so that a banknote insertion slot 5 corresponds to the insertion slot G22*a* of the bill entry G22. In this way, the banknote processing device 1 receives a banknote T inserted through the insertion slot 22*a* of the bill entry 22. That is, the banknote processing device 1 is embedded in the slot machine G10 so that banknotes T can be inserted into the banknote insertion slot 5 from the outside.

The banknote processing device 1 is detachably provided in the cabinet G11 of the slot machine G10. The banknote processing device 1 includes a banknote accommodation unit (banknote stacker) 100 which is an accommodation unit in which banknotes T inserted into the banknote insertion slot 5 which is an insertion slot are accommodated. The banknote processing device 1 reads the banknote information of an inserted banknote T.

A PTS terminal 700 is inserted into the cabinet G11 from the front surface side of the slot machine G10 and is embedded in the slot machine G10 so as to form a part of the front surface of the cabinet G11. The PTS terminal 700 is connected to each of the banknote processing device 1 and a game controller G100 controlling processes executed by the slot machine G10, so as to enable data communication with each of the connected devices.

Figure 2:
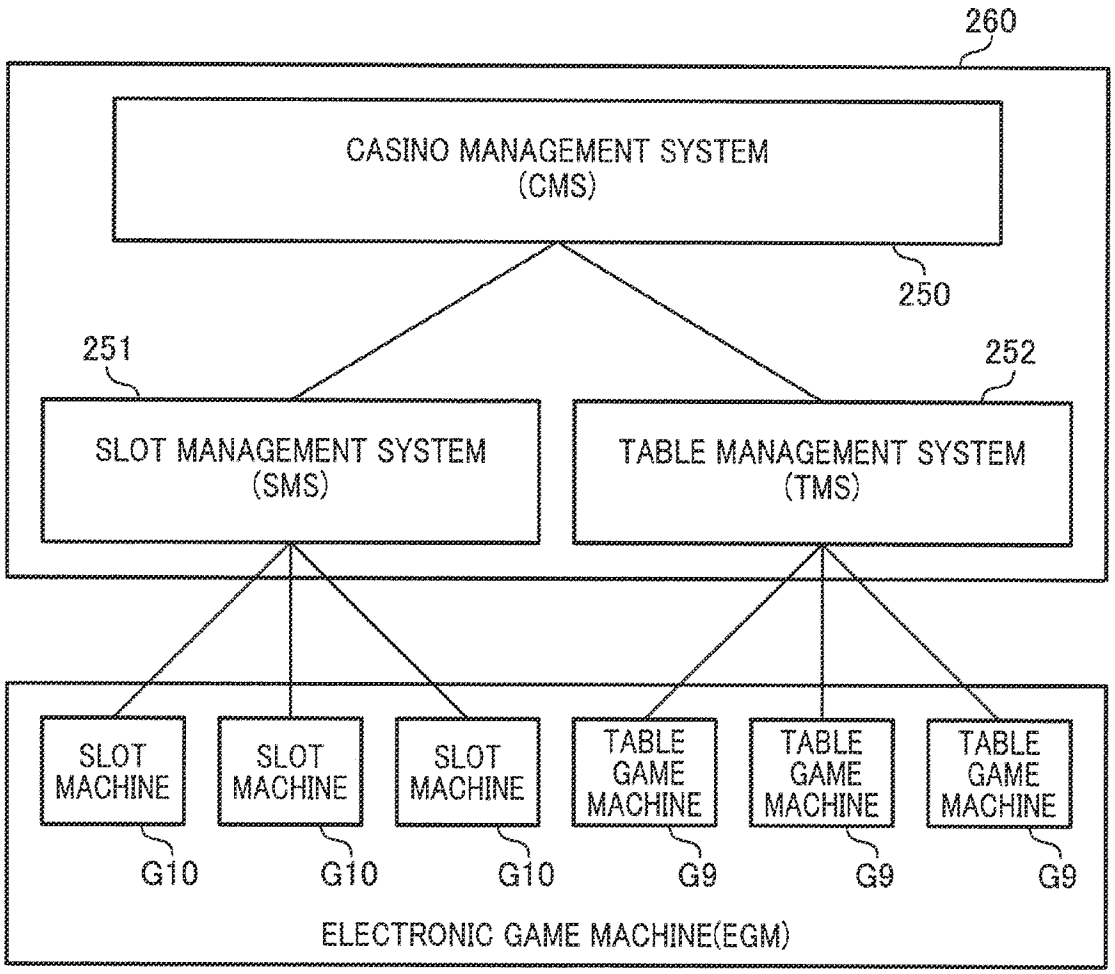
FIG. 2 is a block diagram of the functional configuration of a management server.

The following will describe the functional configuration of the management server 260 of the present embodiment, with reference to FIG. 2. As shown in FIG. 2, the management server 260 includes a casino management system 250, a slot machine management system 251, and a table management system 252. The slot machine management system 251 is connected to a plurality of slot machines G10 in a data communicable manner, and has a function of receiving and totaling sales information such as bet information and payout information from each slot machine G10.

The table management system 252 is connected to a plurality of table game machines G9 other than the slot machine G10 in a data communicable manner. Although not specifically described, each table game machine G9 is an electronic game machine (EGM) capable of executing table games such as poker, baccarat, and roulette and functions as a banknote processing terminal similar to the slot machine G10 in the present embodiment. The table management system 252 has a function of receiving and totaling sales information such as bet information and payout information from each slot machine G9.

The casino management system 250 is a system configured to control all gaming machines managed by the management server 260, and has a function of managing sales information totaled up by the slot machine management system 251 and the table management system 252. The casino management system 250 also has a function, which is related to exchange rates, such as a function of receiving an input regarding exchange rates of plural foreign currencies and a function of sending an exchange rate to each slot machine G10.

An input regarding exchange rates of plural foreign currencies is manually made into the casino management system 250 by, e.g., an administrator who is allowed to set exchange rates. However, the disclosure is not limited to this. The casino management system 250 may have a function of obtaining exchange rates of plural foreign currencies from, e.g., a server configured to manage exchange rates. The exchange rates are applied at a predetermined timing, and are sent to the slot machine G10 via the slot machine management system 251 and to the table game machine G9 via the table management system 252.

In the present embodiment, foreign currencies are exchanged by the PTS terminal 700 in the slot machine G10. That is, when the banknote processing device 1 receives a piece of a foreign currency from a user, the PTS terminal 700 of the slot machine G10 obtains an exchange rate regarding this piece of the foreign currency from the casino management system 250 via the slot machine management system 251 and exchanges the received piece of the foreign currency for at least one piece of a local currency. In this regard, the word "exchange" refers to a process of associating a user with data indicating a physical local currency which is converted from a foreign currency. However, the disclosure is not limited to this. For example, the process of associating a user corresponds to a process of writing data indicating the converted local currency into an IC card inserted into the PTS terminal 700 and a process of adding data indicating the converted local currency to the money owned by a user who performed the exchange in a server configured to manage the money of the user.

While in the embodiment above exchange is done by the PTS terminal 700 of the slot machine G10, exchange may be done by the casino management system 250 or the slot machine management system 251. That is, the slot machine G10 sends information (currency type, amount, etc.) regarding a foreign currency to the management server 260, and the management server 260 executes exchange based on the set exchange rate and sends information including the monetary amount of a local currency after the exchange back to the slot machine G10.

In the present embodiment, the management server 260 has functions of the casino management system 250, the slot machine management system 251, and the table management system 252. However, the disclosure is not limited to this. For example, when the management server 260 manages only the slot machine G10, the management server 260 may be arranged not to include the table management system 252. In this case, the slot machine management system 251 may have a function of the casino management system 250. That is, the slot machine management system 251 may have functions such as a function of receiving an input regarding exchange rates of plural foreign currencies and a function of sending an exchange rate to each slot machine G10. The management server 260 is not limited to one server device, and may be provided as plural devices.

The following will specifically describe the mechanical structure of the PTS terminal 700 of the present embodiment.

Figure 3:
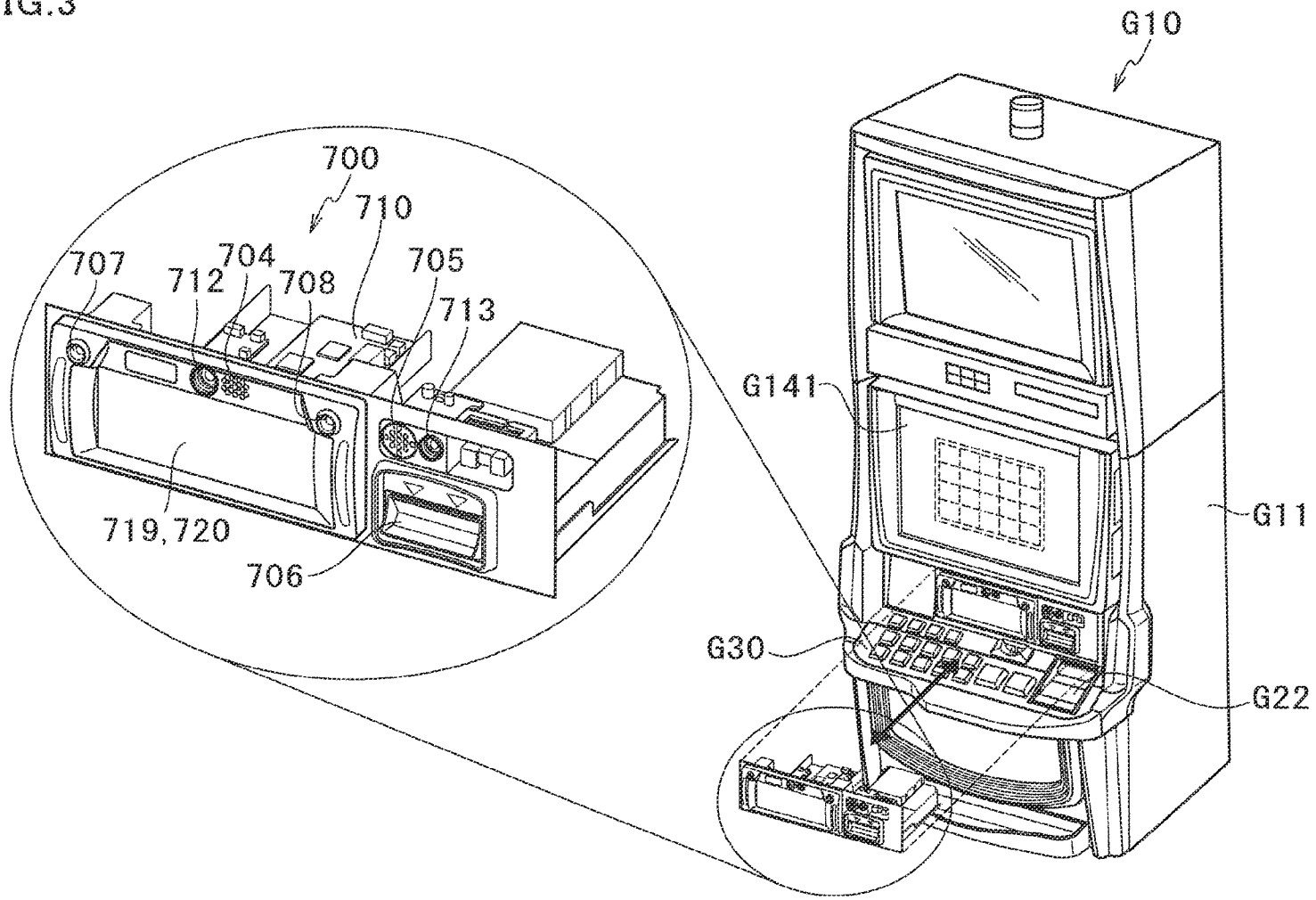
FIG. 3 is an enlarged perspective view of a PTS terminal.

As shown in FIG. 3, the PTS terminal 700 is provided in the slot machine G10 and between a game image display panel G141 which displays game images and a control panel G30 on which members such as buttons for controlling a game and the above-described bill entry G22 are provided. The PTS terminal 700 includes the LCD 719, the touch panel 720, human detection cameras 712 and 713, microphones 704 and 705, speakers 707 and 708, a card insertion slot 706, and a smart interface board 710.

The LCD 719 displays an effect image used for an effect in a game, information displayed when there is a payout as a game result, etc. The touch panel 720 is provided on the LCD 719 to cause the PTS terminal 700 to function as an input device capable of receiving an operation input from the outside. The human detection cameras 712 and 713 make it possible to detect the presence of a player by a camera function. The microphones 704 and 705 are used for allowing a player to participate in a game through the input of player's voice and for authenticating a player by voice recognition. The speakers 707 and 708 perform effects in a game by sound and output various types of notification sound. The card insertion slot 706 has a mechanism which allows an IC card such as a member card of a player of a game to be inserted or removed. The smart interface board 710 connected to the above-described components is a control board configured to control the components, and controls sending and receiving of signals to and from the outside such as the management server 260.

The following will describe the electrical configuration of the slot machine G10 and management server 260 of the present embodiment.

Figure 4:
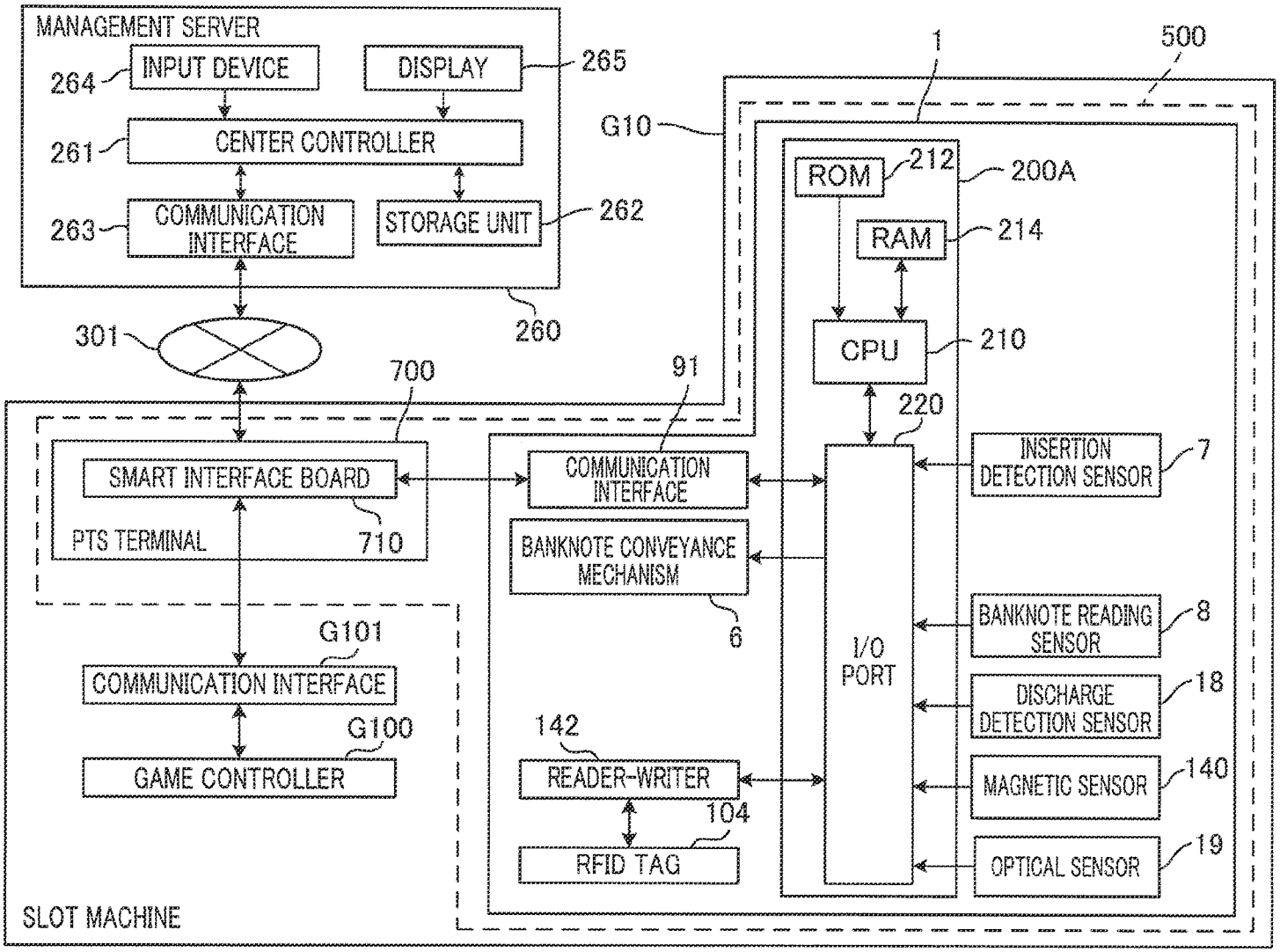
FIG. 4 is a block diagram of the electrical configuration of a banknote processing system.

As shown in FIG. 4, in the slot machine G10, the banknote processing terminal 500 including the banknote processing device 1 and the PTS terminal 700 is connected to the management server 260 through a communication line 301. To be more specific, each of the banknote processing device 1 and the game controller G100 is connected to the PTS terminal 700, and the PTS terminal 700 is connected to the management server 260 through the communication line 301.

The banknote processing device 1 includes a control circuit board 200A, and the control circuit board 200A has thereon a CPU (Central Processing Unit) 210, a ROM (Read Only Memory) 212, a RAM (Random Access Memory) 214, and an I/O port 220.

The CPU 210 is connected to a banknote conveyance mechanism 6 through the I/O port 220. The banknote conveyance mechanism 6 allows banknotes having been inserted through the banknote insertion slot 5 to be conveyed along the insertion direction, allows banknotes being inserted to be sent back toward the banknote insertion slot 5, and allows banknotes being inserted to be accommodated into a banknote accommodation unit 100. Although not illustrated, the banknote conveyance mechanism 6 includes a conveyance roller conveying banknotes, a driving source such as a motor configured to drive the conveyance roller, and sensors configured to detect a state of conveyed banknotes and a state of banknotes in the banknote accommodation unit 100. The CPU 210 drives and controls the driving source based on detection signals from these sensors. Through the I/O port 220, the CPU 210 is connected to an insertion detection sensor 7 configured to detect banknotes having been inserted through the banknote insertion slot 5, a banknote reading sensor 8 configured to read information of banknotes being conveyed in the banknote conveyance mechanism 6, a discharge detection sensor 18 configured to detect banknotes being discharged into the banknote accommodation unit 100, a magnetic sensor 140 configured to detect whether banknotes accommodated in the banknote accommodation unit 100 reach a predetermined number, and an optical sensor 19 configured to detect the banknote accommodation unit 100 being attached or detached.

In the ROM 212, the following sets of data are stored: programs such as an actuation program of driving devices configured to control the banknote conveyance mechanism 6 and a verification program regarding banknotes which are read by the banknote reading sensor 8; and permanent data. The CPU 210 generates control signals according to the programs stored in the ROM 212, inputs and outputs signals to and from the above-described banknote conveyance mechanism 6 through the I/O port 220, and drives and controls the driving devices. The ROM 212 further stores reference data used for determining the validity of banknotes, e.g., sets of data acquired from the entire print region of a valid banknote (e.g., data regarding light and shade and data regarding transmitted light and reflected light when infrared light is applied to a banknote). The RAM 214 stores data and a program used in operation of the CPU 210. The RAM 214 further stores information such as banknote information which is stored in a later-described RFID tag 104 and which is read from banknotes and identification information by which the attached banknote accommodation unit 100 is identified. The identification information by which the banknote accommodation unit 100 is identified is stored in the RFID tag 104 of the banknote accommodation unit 100 in advance, and is stored in the RAM 214 when the banknote accommodation unit 100 is attached.

The CPU 210 is connected to the banknote reading sensor (e.g., line sensor) 8 through the I/O port 220 as described above, banknote reading data which is read from a banknote by the banknote reading sensor 8 is compared with the reference data stored in the ROM 212, and a verification process of verifying the banknote is executed. The banknote reading sensor 8 reads a currency type and monetary amount of a banknote from the banknote received by the banknote processing device 1.

The CPU 210 sends, through the I/O port 220, banknote information regarding a banknote which is determined as a valid banknote to a reader-writer 142. To put it differently, the CPU 210 compares banknote reading data of a banknote read by the banknote reading sensor 8 with the reference data stored in a reference data storage unit 216. When the verification process of verifying the banknote is executed and the banknote is determined as a valid banknote, the CPU 210 activates the reader-writer 142 to write the information of the valid banknote in the RFID tag 104 provided in the banknote accommodation unit 100.

In this case, in addition to the banknote information (e.g., monetary amount information) of the accommodated banknote, time information indicating the time of insertion of the banknote and unique ID information of a device main body 2 may be stored in the RFID tag 104, in association with the banknote information. To be more specific, for example, when the banknote accommodation unit 100 is attached to the device main body 2, the unique ID information assigned to the device main body 2 of the banknote processing device 1 in advance is written into a storage unit 104*b* of the RFID tag 104 to associate the device main body 2 with the banknote accommodation unit 100.

The I/O port 220 is connected to a communication interface 91. The communication interface 91 is connected to the smart interface board 710 of the PTS terminal 700 so as to enable data communication with the PTS terminal 700. The banknote processing device 1 sends, via the communication interface 91, a banknote information signal based on banknote information read from a banknote by the banknote reading sensor 8 to the PTS terminal 700.

The slot machine G10 includes the game controller G100 which controls the control panel G30 and the game image display panel G141 described above and which runs a game. Although not illustrated, the game controller G100 includes a CPU, a ROM, a RAM, and an I/O port to which members such as the control panel G30 and the game image display panel G141 are connected. The game controller G100 is connected to a communication interface G101 so as to enable data communication with the PTS terminal 700. Through the communication interface G101, the slot machine G10 sends a game result and game information such as the content of a bet on a game to the PTS terminal 700.

In the slot machine G10, when the game controller G100 receives credit information from the PTS terminal 700, the game controller G100 executes a process related to a game such as addition of a credit amount included in this credit information to a credit owned by a player. The game controller G100 determines the content of a bet based on an input to the control panel G30 by the player, subtracts a credit indicated by the content of the bet from the owned credit, and starts the game based on the content of the bet.

The PTS terminal 700 includes the smart interface board 710 which controls the LCD 719 which is a display unit, the touch panel 720 which is an input unit, the human detection cameras 712 and 713, the microphones 704 and 705, and the speakers 707 and 708 described above and which controls sending and receiving of signals to and from the outside. Although not illustrated, the smart interface board 710 includes a CPU, a GPU, a ROM, a RAM, and a communication interface by which communications under various standards with the outside are realized. Non-limiting examples of the communication standards supported by the smart interface board 710 include RS232C, RS485, optical isolation, and USB. The smart interface board 710 has a function as an Ethernet (registered trademark) controller and is arranged to enable communication with the management server 260 through the communication line 301.

Although not illustrated, the PTS terminal 700 is able to obtain exchange rates of plural currencies from the management server 260. In the PTS terminal 700, when a banknote received by the banknote processing device 1 is determined as a piece of a foreign currency based on a banknote information signal from the banknote processing device 1, the smart interface board 710 calculates a corresponding credit amount on the premise that the piece of the foreign currency is exchanged for at least one piece of a currency used in a circulation zone where the slot machine G10 is provided and sends the credit amount to the slot machine G10 as a credit information signal. Furthermore, the smart interface board 710 has a function of sending game information to the management server 260 when receiving the game information from the slot machine G10.

The smart interface board 710 functions as a control unit configured to store information indicating that confirmation is unnecessary in the RAM when the touch panel 720 receives the selection (i.e., touch input to the first approval button 721*d*) indicating that no further confirmation is necessary by the confirmation screen 721, and to cancel the display of the confirmation screen 721 when a piece of a foreign currency is received and the information is stored in the RAM. The smart interface board 710 further has a function of resetting information indicating that confirmation is unnecessary, based on a signal from the management server 260.

In the present embodiment, information indicating that confirmation is unnecessary is a confirmation-unnecessary flag which indicates an ON/OFF state stored in the RAM of the smart interface board 710. The smart interface board 710 determines whether to cancel execution of a display process of displaying the confirmation screen 721, based on whether a confirmation-unnecessary flag is in an ON state or in an OFF state. That is, the smart interface board 710 determines whether to execute the exchange of a foreign currency after the confirmation by a user or to automatically execute the exchange of a foreign currency without the confirmation by a user, based on a confirmation-unnecessary flag.

The management server 260 is a computer and includes members such as a center controller 261, a storage unit 262 storing information supplied from the PTS terminal 700, etc., a communication interface 263 by which sending and receiving of signals to and from the outside are realized, an input device 264, and a display 265. Although not illustrated, the center controller 261 includes a CPU, a ROM, a RAM, and an I/O port to which members such as the storage unit 262 and the communication interface 263 are connected. The input device 264 is not limited to a mouse, keyboard, and the like connected to the management server 260, and may be a terminal connected so as to enable remote operation or the registration and modification of data. The center controller 261 controls the storage unit 262, the communication interface 263, the display 265, and the like connected to the controller 261, based on an input from the input device 264 and a signal from the slot machine G10. When the center controller 261 receives exchange rates sent from the casino management system 2 (see FIG. 2), the center controller 261 sends the exchange rates to the slot machine G10 which is connected in a data communicable manner.

The center controller 261 has a function of setting a timing to reset information which is stored in the smart interface board 710 of the PTS terminal 700 and which indicates that confirmation is unnecessary. In the present embodiment, information indicating that confirmation is unnecessary is reset at predetermined intervals, when an exchange rate is changed, or when a user playing a game at the gaming machine ends the game.

The following will describe display screens displayed on the LCD 719 in the PTS terminal 700 of the present embodiment.

Figure 5:
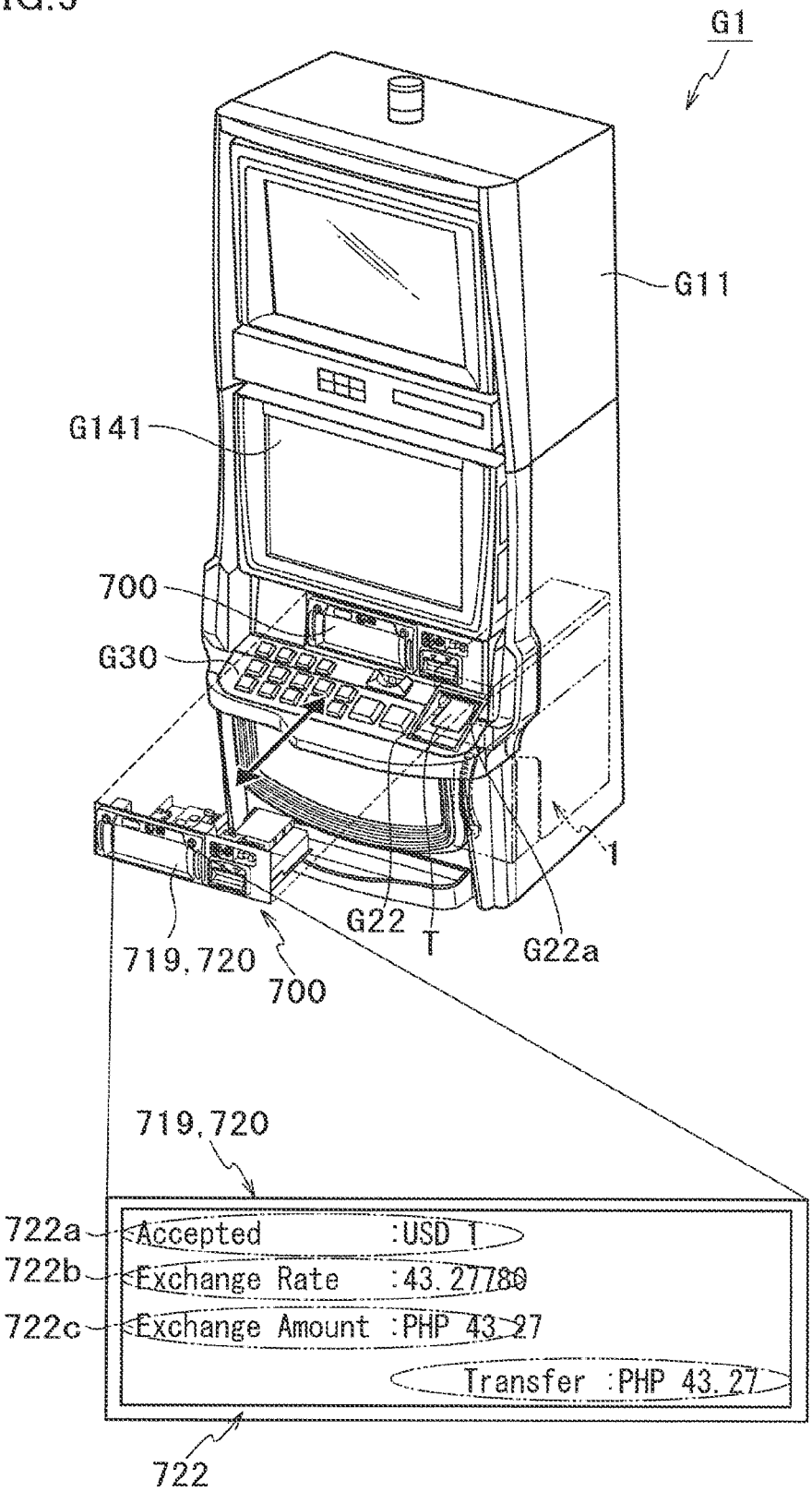
FIG. 5 shows a display screen displayed at the PTS terminal.

As shown in FIG. 5, the LCD 719 displays a notification screen 722 in addition to the confirmation screen 721 (see FIG. 1). The notification screen 722 is displayed after a touch input is made into the input area of the first approval button 721*d* or the input area of the second approval button 721*e* on the confirmation screen 721 and a foreign currency is exchanged. The notification screen 722 is displayed when the exchange of a foreign currency is further done after a touch input is made into the input area of the first approval button 721*d* on the confirmation screen 721 and a foreign currency is exchanged.

Being different from the confirmation screen 721, the notification screen 722 does not display an input area for approving exchange and an input area for refusing exchange. To be more specific, the notification screen 722 displays received banknote information 722*a* indicating a currency type and monetary amount of a received banknote T, exchange rate information 722*b* indicating an exchange rate, exchange information 722*c* indicating a monetary amount of a local currency after the exchange, and a monetary amount which is sent to the slot machine G10 as credits from a monetary amount of a local currency after the exchange.

Figure 6:
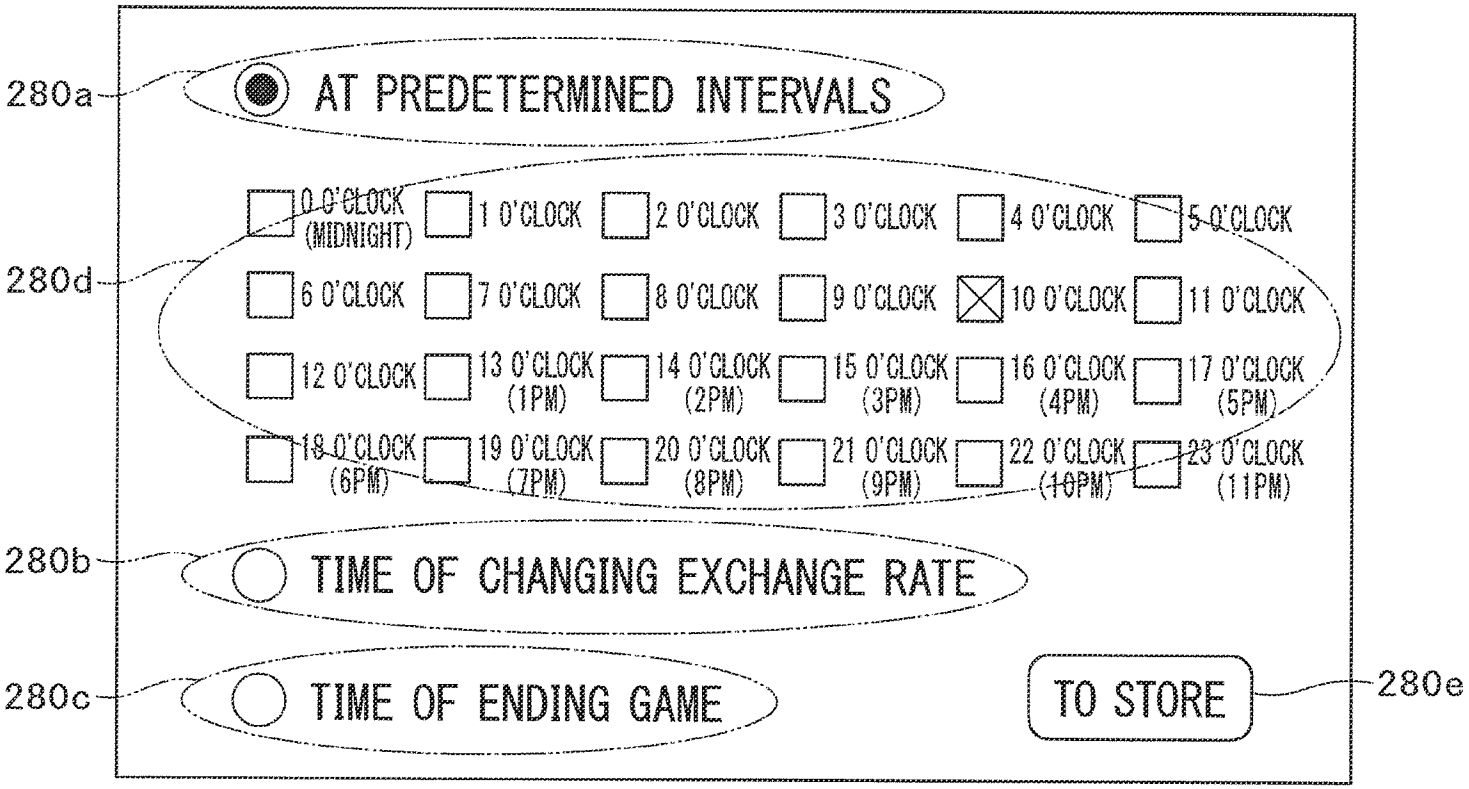
FIG. 6 shows a setting screen of the management server.

The following will describe a reset setting screen 280 which is displayed at a time of setting a timing to reset information indicating that confirmation is unnecessary in the management server 260 of the present embodiment, with reference to FIG. 6. This display screen is displayed onto, e.g., the display 265 of the management server 260 and a terminal which is connected so as to enable remote operation or the registration and modification of data.

As shown in FIG. 6, the reset setting screen 280 is displayed to allow a user to determine that information indicating that confirmation is unnecessary is reset at predetermined intervals, reset when the exchange rate is changed, or reset when the user playing at the gaming machine ends the game. To be more specific, the following buttons are displayed to allow a user to determine when the information is reset: a first timing selection button 280*a* which sets a timing to reset the information so as to be at predetermined intervals; a second timing selection button 280*b* which sets a timing to reset the information so as to be when exchange rates are changed; and a third timing button 280*c* which sets a timing to reset the information so as to be at the end of a game. These three buttons 280*a* to 280*c* are radio buttons that allow a user to select only one of the options at one time.

The phrase "when an exchange rate is changed" refers to a timing when the exchange rate is changed in the management server 260. In other words, the phrase "when exchange rates are changed" refers to a timing when the management server 260 obtains exchange rates from the casino management system 2 in the present embodiment. However, the disclosure is not limited to this. In the present embodiment, the phrase "at the end of a game" refers to a timing when a user takes out a member card from the card insertion slot 706 of the PTS terminal 700. However, the disclosure is not limited to this.

On the reset setting screen 280, the first timing selection button 280*a* displays a time setting area 280*d*. The time setting area 280*d* is provided with twenty-three check boxes which respectively indicate 0 o'clock to 23 o'clock. These check boxes allow a user to set when the reset is performed. It is able to select plural check boxes from among these twenty-three check boxes at one time, and information indicating that confirmation is unnecessary is reset at each selected time point every day.

The reset setting screen 280 further displays a setting reflection button 280*e*. The setting reflection button 280*e* is an input area for reflecting the content of setting. When the content of setting of a timing to reset is reflected into the management server 260, the management server 260 sends the content of setting to PTS terminals 700 of all connected slot machines G10.

Figure 7:
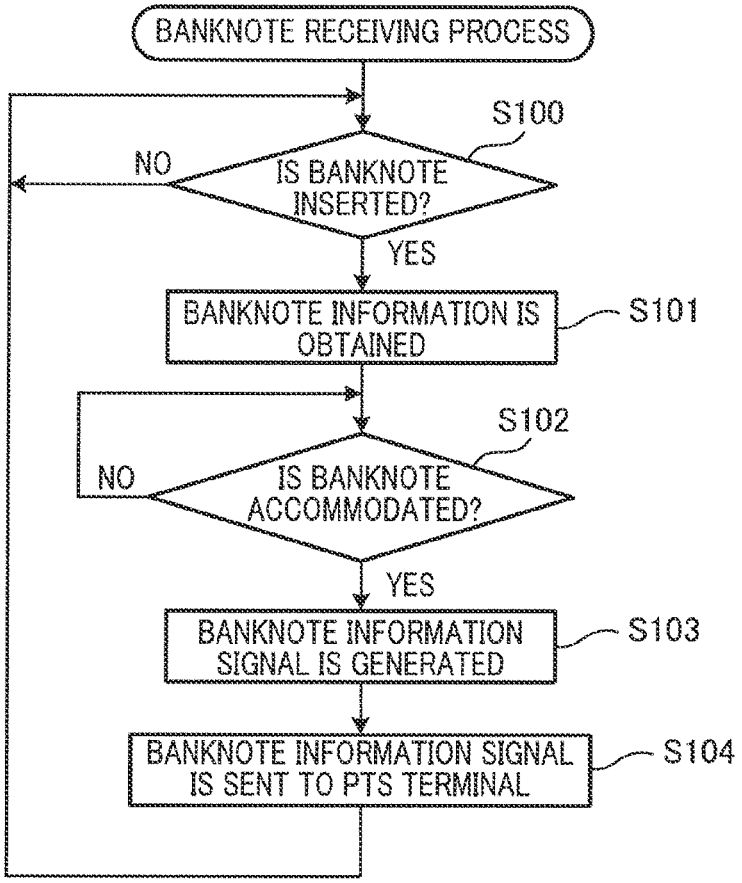
FIG. 7 is a flowchart of a banknote receiving process executed by a banknote processing device.

The following will describe a flowchart of a banknote receiving process executed by the CPU 210 of the banknote processing device 1 when the banknote processing device 1 receives a valid banknote, with reference to FIG. 7. It should be noted that descriptions of conveyance of the banknote are omitted.

To begin with, the CPU 210 determines whether a valid banknote is inserted (S100). When a valid banknote is not inserted (NO in S100), the CPU 210 executes the step S100 again and waits for the insertion of a valid banknote. When a valid banknote is inserted (YES in S100), the CPU 210 acquires banknote information of the inserted banknote based on a signal from the banknote reading sensor 8 (see FIG. 4, FIG. 5, and FIG. 7; S101). In this regard, banknote information is a currency type of a banknote, a banknote type of a banknote, and a monetary amount of a banknote, etc.

Based on a signal from the discharge detection sensor 18 (see FIG. 5 and FIG. 7), the CPU 210 determines whether the banknote from which the banknote information has been read is accommodated in the banknote accommodation unit 100 (S102). When the banknote is not accommodated in the banknote accommodation unit 100 (NO in S102), the CPU 210 executes the step S102 again and waits for the accommodation of the banknote in the banknote accommodation unit 100. When the banknote is accommodated in the banknote accommodation unit 100 (YES in S102), the CPU 210 generates a banknote information signal based on the acquired banknote information (S103). To be more specific, a banknote information signal includes location information of the slot machine G10, stacker identification information for identifying the banknote accommodation unit 100, a currency type of an accommodated banknote, and a banknote type, etc. The CPU 210 then sends the generated banknote information signal to the PTS terminal 700 (S104), and the return to the step S100 occurs.

Figure 8:
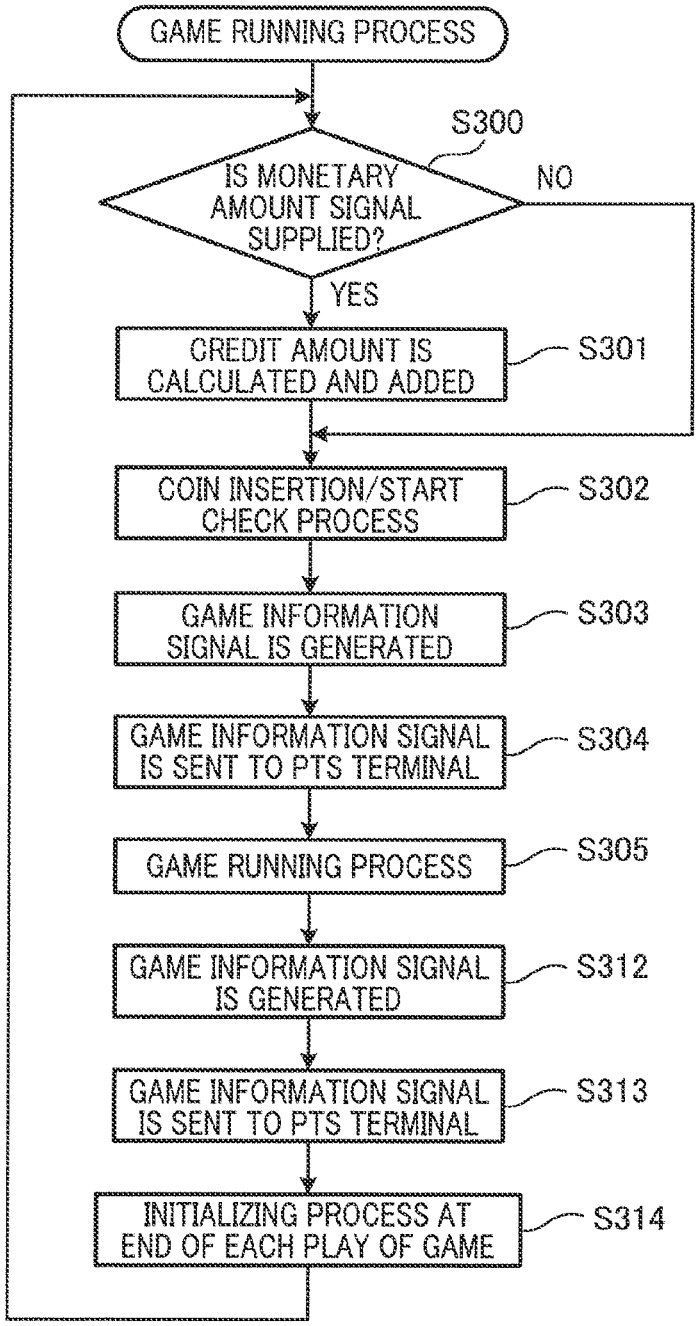
FIG. 8 is a flowchart of a game running process executed by a slot machine.

The following will describe a flowchart of a game running process executed by the game controller G100 of the slot machine G10 with reference to FIG. 8.

To begin with, the game controller G100 determines whether a monetary amount signal has been supplied from the PTS terminal 700 (S300). As described later, a monetary amount signal is a signal including a monetary amount indicated by a banknote which is received by the banknote processing device 1. When the monetary amount signal has been supplied (YES in S300), the game controller G100 calculates a credit amount regarding the monetary amount signal based on a set denomination and adds the credit amount to a credit amount which is stored in the storage area and which is owned by a player (S301). In this regard, the word "denomination" refers to a monetary amount of a local currency corresponding to 1 credit. For example, if 1 credit corresponds to 10 Filipino pesos, the denomination is 10 Filipino pesos. In this regard, the denomination may be set by either the game controller G100 or the PTS terminal 700. When the denomination is set by the PTS terminal 700, the game controller G100 executes a process of obtaining the denomination from the PTS terminal 700.

After the step S301 or when no monetary amount signal is supplied (NO in S300), the game controller G100 executes a coin-insertion start-check process (S302). In this process, the control panel G30 checks inputs to the bet switch and the spin switch, etc., and a betted credit amount is subtracted from the owned credit amount. The game controller G100 then generates a game information signal based on information such as identification information by which the slot machine G10 is identified, information indicating the start of a game, information indicating a credit betted on the game, and information indicating the unit (denomination) of the credit (G303), and sends the generated game information signal to the PTS terminal (S304).

The game controller G100 then executes the game running process (S305). In the game running process, the game controller G100 randomly determines symbols displayed in a symbol display area and outputs a game result in accordance with a combination of the displayed symbols. The game controller G100 then runs a slot game which awards a credit payout based on a betted credit amount and an output game result. For example, the symbol display area is provided with twenty areas forming a matrix with five columns and four rows and is displayed on the game image display panel G141 so that one symbol is placed in each area.

To be more specific, the game controller G100 determines to-be-stopped symbols based on a random number in the game running process. Subsequently, the game controller G100 samples an effect-use random number and randomly selects any of a plurality of predetermined effect contents. The game controller G100 then displays, on the game image display panel G141, an effect of stopping symbols in the symbol display area, based on the to-be-stopped symbols and the effect content which have been determined. The game controller G100 then determines a payout amount based on a combination of symbols in the symbol display area. When there is a payout as a result of the game above, the game controller G100 adds a payout amount to the owned credit amount.

In the game running process, the game controller G100 may execute a bonus game including at least one free game in accordance with a combination of symbols in the symbol display area and the conditions of other random determinations, etc. In this regard, the free game is a game runnable with no bet.

The game controller G100 then generates a game information signal based on information such as identification information by which the slot machine G10 is identified, information indicating the end of the game, and information indicating a payout credit based on a game result (G312), and sends the generated game information signal to the PTS terminal (S313).

The game controller G100 then executes an initializing process at the end of each play of the game (S314), and causes the return to the step S300. This initializing process at the end of each play of the game clears data in a working area of the RAM, etc. of the game controller G100, which becomes unnecessary at the end of each play of the game. Examples of such include a bet amount and a randomly determined symbol.

Figure 9:
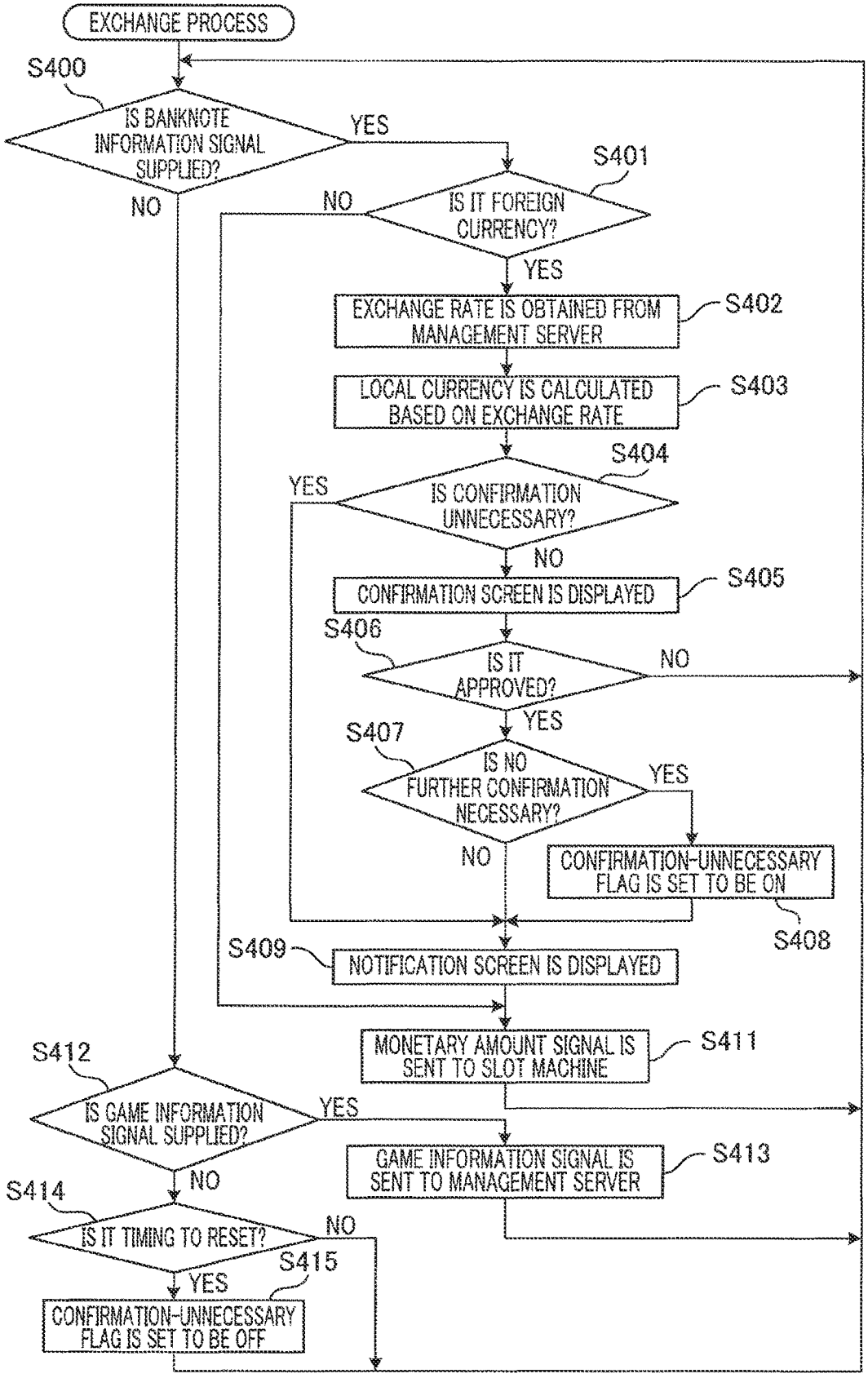
FIG. 9 is a flowchart of an exchange process executed by the PTS terminal.

The following will describe a flowchart of an exchange process executed by the smart interface board 710 of the PTS terminal 700, with reference to FIG. 9.

To begin with, the smart interface board 710 determines whether a banknote information signal is supplied from the banknote processing device 1 (S400). When the banknote information signal is supplied from the banknote processing device 1 (YES in S400), the smart interface board 710 determines whether a banknote received by the banknote processing device 1 is a foreign currency based on the banknote information signal (S401). When the banknote is a foreign currency (YES in S401), the smart interface board 710 obtains an exchange rate regarding the foreign currency from the management server 260 (S402). The smart interface board 710 then calculates a monetary amount of a local currency corresponding to the received piece of the foreign currency based on the exchange rate (S403).

Subsequently, the smart interface board 710 determines whether the confirmation of exchange is unnecessary (S404). That is, the smart interface board 710 determines whether a stored confirmation-unnecessary flag is in an ON state. When the confirmation of exchange is not unnecessary (NO in S404), the smart interface board 710 displays the confirmation screen 721 (see FIG. 1) onto the LCD 719 (S405). The smart interface board 710 then determines whether exchange has been approved on the confirmation screen 721 (S406). That is, the smart interface board 710 determines whether a touch input has been made into the input area of the first approval button 721*d* or the input area of the second approval button 721*e* on the confirmation screen 721. When exchange is not approved on the confirmation screen 721 (NO in S406), the smart interface board 710 causes the return to the step S400. At this step, the smart interface board 710 may send an instruction signal to the banknote processing device 1 to discharge the received banknote.

When exchange has been approved on the confirmation screen 721 (YES in S406), the smart interface board 710 determines whether no further confirmation is necessary (S407). That is, the smart interface board 710 determines whether a touch input has been made into the input area of the first approval button 721*d* on the confirmation screen 721. When no further confirmation is necessary (YES in S407), the smart interface board 710 sets a confirmation-unnecessary flag to be in an ON state (S408).

When it has been determined that the confirmation of exchange is unnecessary in the step S404 (YES in S404), when it has been determined that further confirmation is not unnecessary in the step S407 (NO in S407), or after the process of the step S408, the smart interface board 710 displays the notification screen 722 (S409). The smart interface board 710 then sends a monetary amount signal indicating a monetary amount of a local currency corresponding to the received banknote, to the game controller G100 of the slot machine G10 (S411). That is, when the banknote received by the banknote processing device 1 is a local currency, the smart interface board 710 sends a monetary amount of the banknote (local currency) to the game controller G100. Meanwhile, when the received banknote is a foreign currency, the smart interface board 710 sends the monetary amount which has been calculated in the step S403 to the game controller G100. Then, the return to the step S400 occurs.

When a banknote information signal is not supplied from the banknote processing device 1 (NO in S400), the smart interface board 710 determines whether a game information signal is supplied from the slot machine G10 (S412). When a game information signal is supplied from the slot machine G10 (YES in S412), the smart interface board 710 sends the game information signal to the management server 260 (S413) and causes the return to the step S400.

When it has been determined that a game information signal is not supplied in the step S411 (NO in S412), the smart interface board 710 determines whether a timing to reset a confirmation-unnecessary flag has come (S414). When a timing to reset a confirmation-unnecessary flag has not come (NO in S414), the smart interface board 710 causes the return to the step S400. When a timing to reset a confirmation-unnecessary flag has come (YES in S414), the smart interface board 710 sets a confirmation-unnecessary flag to be in an OFF state (S415) and causes the return to the step S400.

In this regard, the smart interface board 710 determines whether a timing to reset a confirmation-unnecessary flag has come as follows. That is, when the flag is reset at predetermined intervals, the smart interface board 710 determines whether a timing to reset a confirmation-unnecessary flag has come based on whether a timing to reset has come based on a signal from, e.g., an unillustrated clock unit. An exchange rate change signal is a signal including information indicating exchange rates of plural currencies, which are sent from the management server 260. When the flag is reset is at the time of changing the exchange rate, the smart interface board 710 determines whether a timing to reset a confirmation-unnecessary flag has come based on whether an exchange rate change signal has been supplied from the management server 260. When the flag is reset at the end of a game, the smart interface board 710 determines whether a timing to reset a confirmation-unnecessary flag has come based on whether a user takes out a member card from the card insertion slot 706 of the PTS terminal 700.

Further, the detailed description above is mainly focused on characteristics of the present invention to for the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the present invention described in this specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

REFERENCE SIGNS LIST

1 banknote processing device
8 banknote reading sensor
100 banknote accommodation unit
104 RFID tag
142 reader-writer
260 management server
261 center controller
262 storage unit
301 communication line
700 PTS terminal
710 smart interface board
1000 banknote processing system
G10 slot machine
G100 game controller

The invention claimed is:

1. A banknote processing terminal, comprising:

a display unit configured to display a confirmation screen for determining whether to execute exchange of a foreign currency;

an input unit configured to receive an input from a user;

a storage unit which stores a content received by the input unit;

a reading unit configured to read information indicating whether a received piece of a currency is a foreign currency; and a control unit, the input unit being able to receive an input for selecting whether no further confirmation is necessary on the confirmation screen, and the control unit storing information indicating that confirmation of whether to execute exchange of a foreign currency is unnecessary in the storage unit when the input unit receives a selection indicating that no further confirmation is necessary, and cancelling display of the confirmation screen when the information indicating that no further confirmation is necessary is stored in the storage unit when a piece of a foreign currency is received.

2. The banknote processing terminal according to claim 1, wherein the control unit resets, at predetermined intervals, the information stored in the storage unit.

3. The banknote processing terminal according to claim 1, wherein the control unit resets, at a time of changing an exchange rate, the information stored in the storage unit.

4. The banknote processing terminal according to claim 1, wherein the banknote processing terminal is a gaming machine, and, the control unit resets, when the user playing the gaming machine ends a game, the information stored in the storage unit.

* * * * *